US005722469A

United States Patent [19]

Tuminaro

[11] Patent Number: 5,722,469

[45] Date of Patent: Mar. 3, 1998

[54] FUEL VERIFICATION AND DISPENSING SYSTEM

[76] Inventor: Patrick Tuminaro, 42938 Staffordshire Dr., Lancaster, Calif. 93534

[21] Appl. No.: 734,026

[22] Filed: Oct. 18, 1996

[51] Int. Cl.[6] ..... B67D 5/33

[52] U.S. Cl. ..... 141/94; 141/83; 141/98; 23/32 R

[58] Field of Search ..... 141/83, 94, 98; 73/32 R; 364/464.23

[56] References Cited

U.S. PATENT DOCUMENTS

| | | | |
|---|---|---|---|
| 3,642,036 | 2/1972 | Ginsburgh et al. | 141/94 |
| 3,927,800 | 12/1975 | Zinsmeyer et al. | 364/464.23 |
| 4,137,753 | 2/1979 | Woodle | 73/32 R |
| 4,263,945 | 4/1981 | Van Ness | 141/98 |
| 4,469,149 | 9/1984 | Walkey et al. | 141/94 |
| 4,550,859 | 11/1985 | Dow, Jr. et al. | 364/464.23 |
| 4,773,253 | 9/1988 | Francisco, Jr. | 73/32 R |
| 4,809,499 | 3/1989 | Dyer | 73/32 R |
| 4,846,233 | 7/1989 | Fockens | 141/94 |
| 4,934,419 | 6/1990 | Lamont et al. | 141/94 |
| 5,156,198 | 10/1992 | Hall | 141/94 |
| 5,204,819 | 4/1993 | Ryan | 364/464.23 |
| 5,209,275 | 5/1993 | Akiba et al. | 141/83 |
| 5,213,142 | 5/1993 | Koch et al. | 141/98 |
| 5,249,612 | 10/1993 | Parks et al. | 141/219 |
| 5,265,460 | 11/1993 | Ellinger et al. | 73/32 R |
| 5,383,500 | 1/1995 | Dwars et al. | 141/98 |
| 5,400,253 | 3/1995 | O'Connor | 364/464.23 |
| 5,605,182 | 2/1997 | Oberrecht et al. | 141/94 |

*Primary Examiner*—J. Casimer Jacyna

*Attorney, Agent, or Firm*—Sughrue, Mion, Zinn, Macpeak & Seas, PLLC

[57] ABSTRACT

A fuel dispensing system has a placard disposed on the device to be fueled. The placard indicates the type of fuel used in the device. An appropriate code reader reads the placard and generates a signal indicative of the fuel type. A fuel dispensing handle is selectively coupled to one of a plurality of fuel storage tanks to dispense the proper fuel. A contamination detection device causes a valve in the fuel dispensing handle to be placed in the closed position when the fuel is contaminated or otherwise not proper for dispensing.

5 Claims, 3 Drawing Sheets

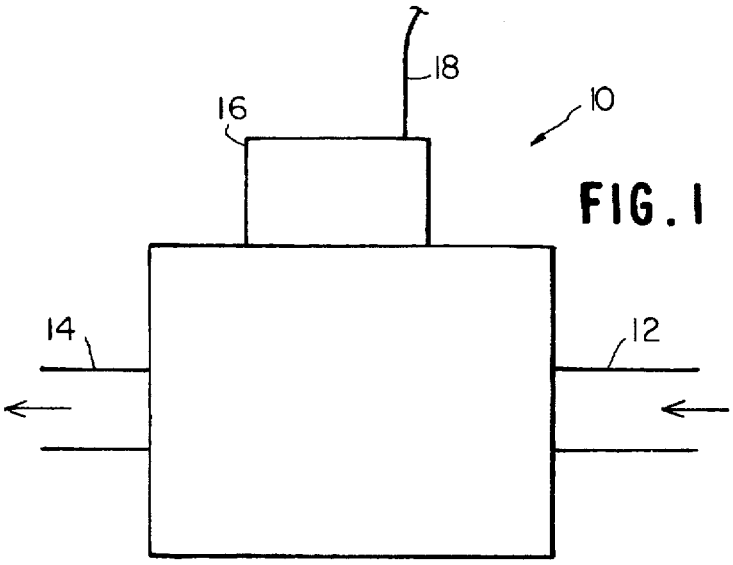
FIG. 1
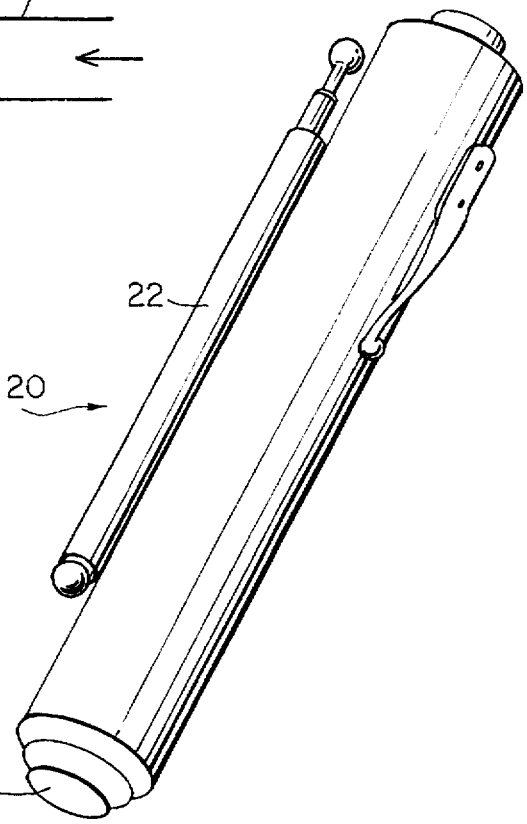
FIG. 2
FIG. 3
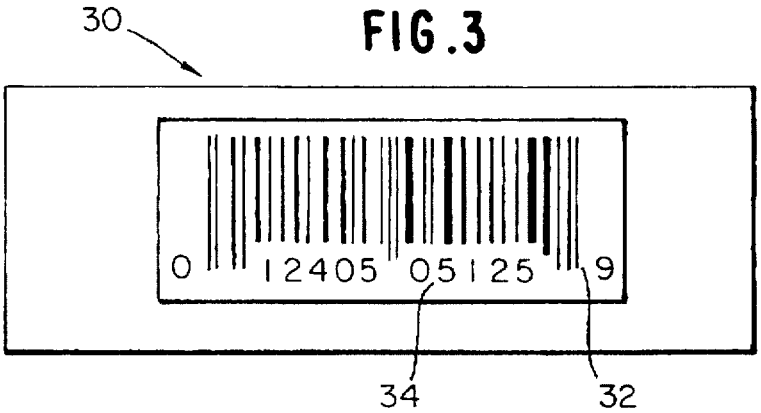

FUEL VERIFICATION AND DISPENSING SYSTEM

BACKGROUND OF THE INVENTION

1. Field of the Invention

The invention relates to a system for verifying the fuel to be dispensed into an aircraft, or other vehicle. Specifically, the invention relates to a system for automatically checking the type of fuel to be dispensed to an aircraft or other vehicle and for automatically dispensing the proper fuel while continuously verifying the quality of the fuel and preventing further dispensing if the quality is substandard.

2. Description of the Related Art

In many vehicles, such as aircraft, improper fueling can be very dangerous. In fact, the Federal Government has several agencies that oversee every aspect of aircraft safety, including fuel specifications and fueling practices. This is so because the quality, purity, and type of fuel are critical to the safe operation of all aircraft. Every year, aircraft failures and crashes are attributed to the improper fueling of aircraft by ground personnel or the contamination of aircraft fuel. Also, contaminated or improper fuel can cause severe damage to the aircraft even if total failure does not occur. Finally, as in other industries, the proper delivery and tracking of fuels used is important to the aircraft industry because of the need to be economically efficient.

To avoid improper fueling, several methods have been employed. The most common of these methods is merely visual matching of the fuel label on a fuel pump or handle to the type of aircraft. However, due to the many types of aircraft and fuels, as well as the quick pace at which ground personnel must work in the aircraft industry, improper fueling occurs too often. Accordingly, there have been several attempts to implement automated checking systems. However, all of these have failed to solve the unique problems associated with the fueling of aircraft. Therefore, at this time, automated systems have not been widely adopted by the airline industry.

U.S. Pat. No. 4,469,149 discloses a vehicle fueling system for providing security and accounting with respect to dispensed fuel. This system requires a narrow neck at the fill point that has a bar code disposed thereon. Therefore, in order to apply this system to aircraft, the aircraft would have to be modified because aircraft fuel tanks do not have a narrowed neck at the fill point. Any modification to aircraft is very impractical because it can be expensive and ordinarily requires approval by at least one government agency. Further, this system requires wires between the fuel handle and other components, is not well adapted to the grounded power requirements needed for aircraft and, most significantly, does not provide for fuel shutoff due to contaminated fuel. U.S. Pat. No. 5,156,198 discloses another type of fuel dispensing system. However this system utilizes induction coils in the fuel neck to indicate fuel type and thus implementing this system on aircraft would require extensive fuel tank modification in order to install induction coils therein. Further, this system is not easily adaptable to the grounded power requirements of aircraft and does not have the capability of detecting contaminated or improper fuel.

Another detection system is disclosed in U.S. Pat. No. 4,846,233. This system uses an antenna to broadcast signals in a wireless manner. However the detection system is based on electromagnetic effects. Because all aircraft are grounded to eliminate the possibility of sparks, this type of system is not acceptable for use with aircraft. Also, extensive fuel tank modification would be required to provide the necessary electromagnetic coils in aircraft and this system does not provide for detecting contaminated fuel.

A fuel management system disclosed in U.S. Pat. No. 4,934,419 uses an optical reader for reading and sending vehicle information and controlling the type of fuel. However, this system requires that a fiber optic transmitter be installed on the vehicle in close proximity to the fuel tank. This is not practical in aircraft because of adverse aerodynamic effects and the need for government approval. U.S. Pat. No. 4,263,945 discloses another fuel dispensing device. However, this device does not provide for the detection of contaminated fuel and the prevention of dispensing contaminated fuel.

U.S. Pat. No. 5,249,612 discloses a fueling system which uses an induction coil proximity sensor. Similar to the devices discussed above, this system would require extensive modification to the aircraft fuel tank and would generate unacceptable magnetic fields. This system is suited to identifying a fuel container used for storage or transport as opposed to a vehicle fuel tank. Finally, U.S. Pat. No. 4,263,945 discloses a fuel dispensing system that uses transmitters and receivers mounted on both the dispensing and receiving containers. However, this system fails to disclose means for identifying contaminated fuel or means for identifying fuel by the specific gravity thereof.

While many fuel dispensing and detection systems have been developed, it is clear that they all fail to address the particular problems associated with fueling aircraft. In fact, the systems disclosed above are not at all suited to use with aircraft and would not solve the problems of fueling aircraft noted above.

SUMMARY OF THE INVENTION

In view of the problems noted above, it is an object of the invention to provide a fuel dispensing system that prevents the wrong fuel from being dispensed to an aircraft fuel tank without the need for modification of the fuel tank.

It is another object of the invention to provide a fuel dispensing system that does not require cables in proximity to the aircraft.

It is another object of the invention to provide a fuel dispensing system that satisfies the grounded power requirements for aircraft.

It is another object of the invention to provide a fuel dispensing system that continuously checks fuel for contamination during dispensing and, when contaminated fuel is detected, shuts off fuel delivery before any contaminated fuel enters the fuel tank of the aircraft.

To accomplish these objectives, the invention includes a bar code placard disposed on the device to be fueled and a portable bar code reader that is coupled to a control system in a wireless manner. The bar code indicates the proper fuel type for the device and is read by the bar code reader. The control system couples the proper fuel source to a fuel handle based on the information contained in the read bar code. As fuel from the proper source is dispensed, a specific gravity analyzer monitors the fuel for contamination and closes a valve in the fuel handle if the specific gravity is not within a predetermined range.

BRIEF DESCRIPTION OF THE DRAWINGS

The invention is described below through a preferred embodiment that corresponds to the drawings in which:

FIG. 1 is a schematic illustration of a fuel valve of the preferred embodiment;

FIG. 2 is a perspective view of the bar code reader of the preferred embodiment;

FIG. 3 illustrates an example of a Universal Product Code (UPC) placard;

DETAILED DESCRIPTION OF THE PREFERRED EMBODIMENT

Figure 4:
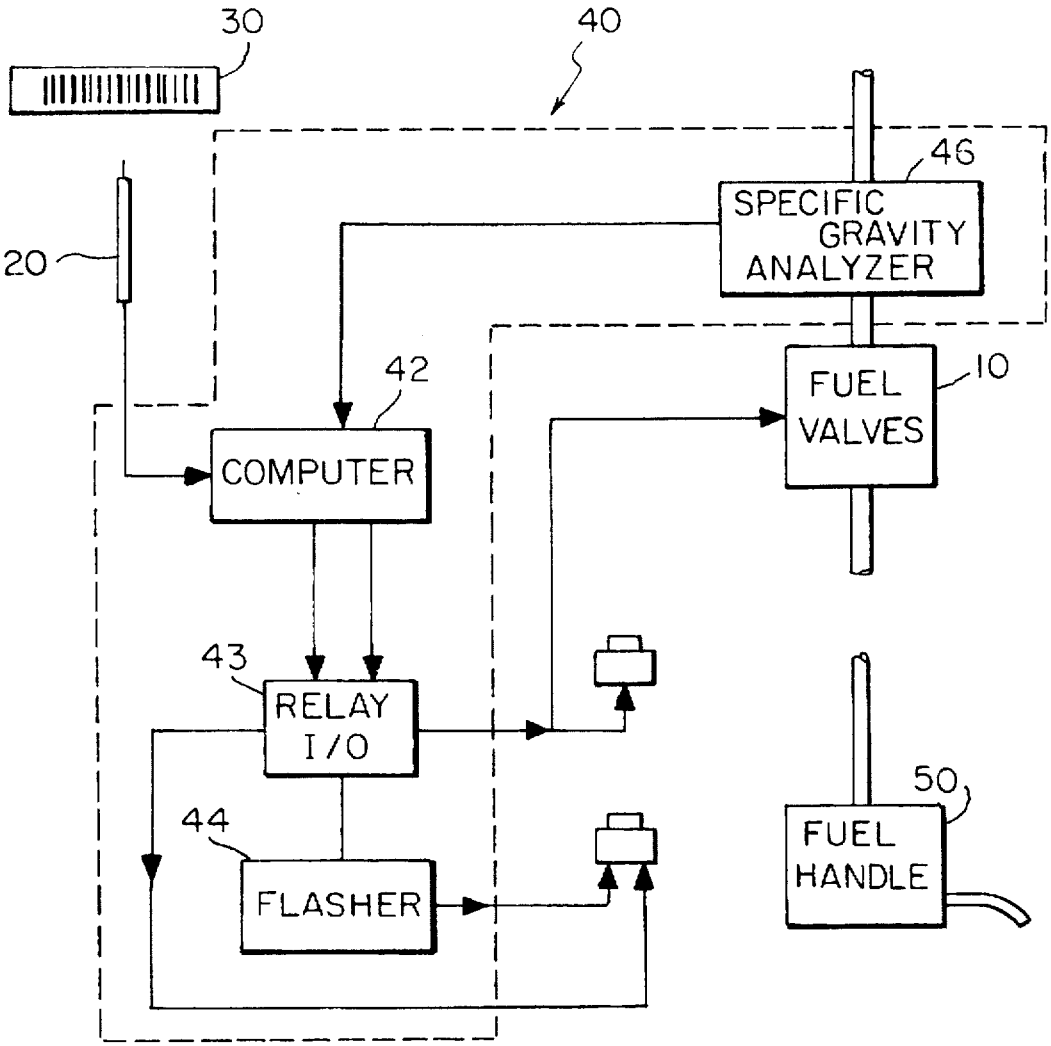
FIG. 4 is a block diagram of the preferred embodiment.

The preferred embodiment includes five primary components. The first primary component is fuel valve 10 illustrated in FIG. 1. Fuel valve 10 can be a standard electronically controlled solenoid valve, such as "ASCO" part number 8292, or any one of a number of appropriate known devices which allow fluid flow to be interrupted by an A.C. or D.C. electrical signal. Fuel valve 10 includes fuel entrance port 12 and fuel exit port 14. In the open state of fuel valve 10, entrance port 12 is in communication with exit port 14 to allow fuel to flow through fuel valve 10. A valve member (not illustrated) is coupled to electric solenoid 16 and is movable to a closed position in which fluid cannot flow through shutoff valve 10. Control cable 18 is coupled to a coil of solenoid 16 to allow fuel valve 10 to be easily switched between the open and closed states based on an electrical signal sent through control cable 18. Ordinarily, the device will be configured to place fuel valve 10 in the closed state in the absence of a signal over control cable 18 in order to provide safety in the event of a power failure or other malfunction. Ordinarily, there will be one fuel valve 10 for each type of fuel to be dispensed. Each of the fuel valves 10 can be coupled to a respective fuel tank or other fuel source.

The second primary component of the preferred embodiment is bar code reader 20 which is illustrated in FIG. 2. Bar code reader 20 is a remote battery operated device that can send information relating to a read bar code via antenna 22. Lens 24 is provided and the operator merely scans lens 24 across a bar code label, such as a Universal Product Code (UPC) label, to read a bar code. Bar code reader 20 can be any one of several known devices used in retail and industrial use or inventory, or the like. Such devices are capable of transmitting a signal which indicates the contents of a scanned label in a known manner. For example, bar code reader 20 can be a model LS2000 made by SYMBOL. This device is well suited because it operates in a frequency range that does not require FCC approval. Also, it is easily interfaced with other hardware through an RS232 port.

The third primary component is placard 30 illustrated in FIG. 3. Placard 30 can contain UPC bar code 32 or any other optically readable label. Placard 30 is placed proximate a refueling receptacle on the aircraft and an individual bar code 32 is defined for each known fuel type. Therefore, placard 30 indicates the type of fuel to be dispensed into the associated fuel receptacle. placard 30 can also contain a human readable indication of the fuel type, such as numbers 34, a color code, or both. Placard 30 is easily mounted on the surface of the aircraft and does not significantly affect the aerodynamic characteristics of the aircraft or require extensive modification of any components of the aircraft. For example, a standard UPC and/or Bar 39 label can be formed on a material that is resistant to chemicals, and UV light. Also, an appropriate adhesive can be used to fix placard 30 to the aircraft.

Figure 5:
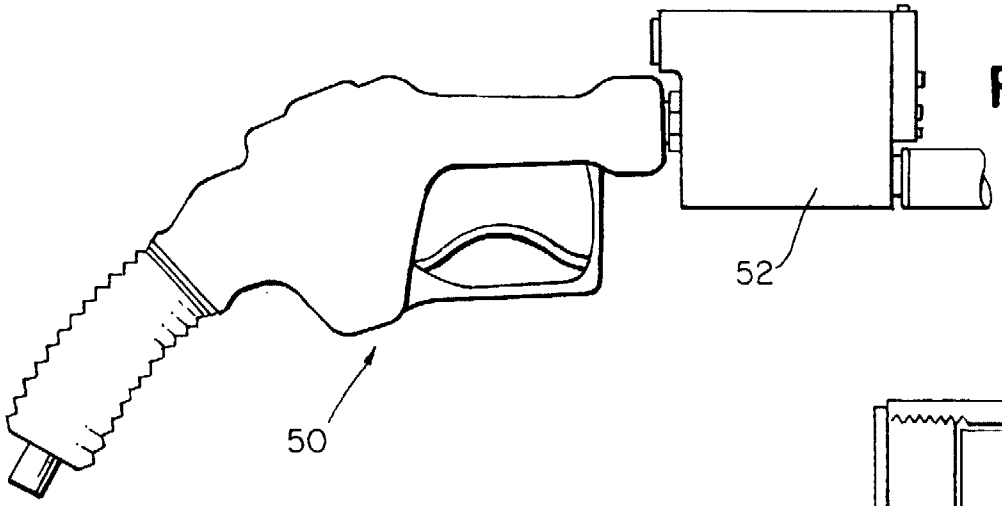
FIG. 5 is a perspective view of the fuel control handle.
Figure 6:
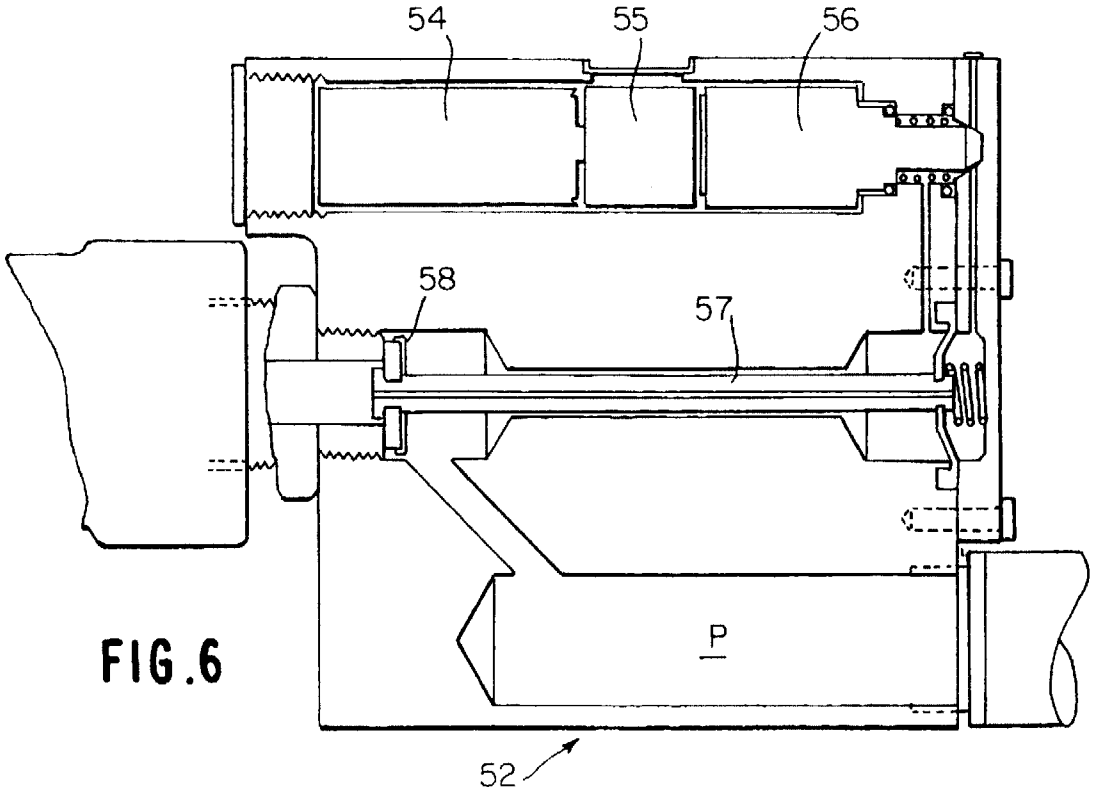
FIG. 6 is a detailed view of the handle auxiliary valve.

The fourth primary component is fuel flow control handle 50 illustrated in illustrated in FIG. 5. In the preferred embodiment, or any fuel control system, a handle serves to allow the operator to manually control the dispensing of fuel to the vehicle tank. Handle 50 of the preferred embodiment is located at the end of a fuel hose and serves to introduce fuel into the vehicle tank neck only after several parameters have been complied with as will be discussed in greater detail below. Handle 50 has auxiliary valve unit 52 which serves to interrupt the flow of fuel at appropriate times. See FIGS. 5 and 6. Auxiliary valve unit 52 has internal battery 54 to provide power to solenoid 56. Solenoid 56 is coupled to shaft 57 which is slidably mounted in cutoff valve unit 52. Valve member 58 is mounted on one end of shaft 57 and is movable between the closed position illustrated in FIG. 6, wherein the fuel flow passage P is isolated from the fuel hose, and an open position in which the fuel flow passage P communicates with the fuel hose. Preferably, shaft 57 and valve member 58 are biased into the closed position to provide a fail safe mode in the event of power failure. Fuel flow control handle 50 also has a radio receiver, not illustrated, that communicates via radio frequency with the control system discussed below. The appropriate signal from the control system places valve member 58 in the opened or closed position. Additionally, a known solar impulse relay can be incorporated into handle 50 to mechanically lock the activation of handle 50 in the event of a detection of fuel contamination.

The fifth primary component of the preferred embodiment is control system 40 which is indicated within the dashed line in FIG. 4. Control system 40 is preferably installed in the refueling vehicle or stand and includes general purpose computer 42, relay input/output interface 43, flasher 44 and specific gravity analyzer 46. For example, the liquid gravimeter model no. R-F10-50X from ARCCO INSTRUMENT CO., INC. can be used as specific gravity analyzer 46. Alternatively, any type of instrument that detects fuel quality can be used. Control system 40 also has appropriate radio transmitters and receivers to communicate with peripheral devices, such as bar code reader 20, fuel valves 10, and fuel handle 50. Computer 42 can be any type of control device, such as a microprocessor based computer programmed in the desired manner. For example, an IBM PC compatible device can be used. A standard bar code software package can be loaded in the computer to decode the signals sent by bar code reader 20. For example, the BR-44 and BR-02 software packages from BEAR ROCK TECHNOLOGIES can be used. Further, computer 42 receives signals from the peripheral devices and in turn controls the appropriate valves and indicators to insure proper refueling.

In operation, computer 40 receives a signal from bar code reader 20 via radio frequency and, based on the fuel indicated by the UPC code read by bar code reader 20, opens the appropriate fuel valve 10 to allow fueling of the vehicle with the proper fuel. During fueling, specific gravity analyzer 46 monitors the specific gravity of the fuel being dispensed and sends an appropriate signal, via radio frequency or by direct wiring, as is applicable in the particular installation, to computer 42. The value of this signal is constantly compared with the known proper value of specific gravity for the fuel being dispensed; the known value being stored in computer 42. The signal from the specific gravity analyzer is transformed into the appropriate R5232 signal, or the like, to be recognized by computer 42. Any standard signal decoder can be used; such as a GSE Model 229 which is readily available. In the event that the specific gravity of the disposed fuel varies outside of predetermined limits, computer 42 can send a cutoff signal to flow control handle 50 and/or to fuel valve 10. If a sensor of specific gravity analyzer 46 is disposed in the fuel flow near the vehicle stand, or at any appropriate position upstream of handle 50, fuel flow can be stopped as soon as contamination is detected and before the contaminated fuel is dispensed into the vehicle fuel tank by closing auxiliary valve unit 52.

Computer 42 is coupled to pilot light indicators, or the like, via relay I/O unit 43 and flasher 44. This allows computer 42 to provide visual indication of the dispensing status, e.g. "ready to dispense fuel", "proper fuel not available" or "contaminated fuel condition", by sending a signal to the pilot indicator associated with a particular label on a control console at the fueling stand or proximate the handle. Of course, a display panel, such as a CRT panel or an LCD panel can be used for more detailed indication and status reports. Also, a keypad, or other input device can be coupled to computer 42 to require that the operator enter a security code or other identification before operating the system. If the proper identification is not entered, the valves can all be placed in the closed position to prevent unauthorized fueling. Also, the system can be coupled to other computer systems through known data links to provide inventory information, accounting information, and other business functions.

The invention disclosed herein through the preferred embodiment discussed above provides a fuel dispensing system that is particularly well suited for use with aircraft. However, the invention can be used to fuel any type of vehicle or fuel burning device. The invention is fully automatic and distinguishes between various types and grades of fuel to prevent erroneous fueling. Also, the invention easily identifies the type of fuel suited for the tank without requiring modification to the tank. The invention further insures that the fuel is not contaminated at any time during the fueling process.

The invention has been described through a preferred embodiment. However, those skilled in he art will recognize that various modifications can be made without departing from the scope of the invention as defined by the appended claims. For example, the various components can communicate through any desired communication link, such as an optical infrared device, or the like.

What is claimed is:

1. A fuel dispensing system comprising:

a placard having bar code information recorded thereon disposed on a device to be fueled;

a bar code reader for reading the bar code information recorded on said placard;

a plurality of fuel valves, each of said fuel valves being associated with a fuel tank containing a particular type of fuel;

a fuel handle which can be selectively coupled to each of said fuel tanks, one at a time, through said fuel valves, said fuel handle being adapted to be inserted into a fuel receptacle of the device to be fueled, said fuel handle having an auxiliary valve disposed therein to selectively prevent fuel from being dispensed through said fuel handle;

a control system coupled to said fuel valves and said fuel handle by a wireless communication device, said control system comprising a controller and a specific gravity analyzer, said specific gravity analyzer having a sensor that is disposed in a flow path of the fuel to monitor the specific gravity of the fuel as the fuel is being dispensed, said control system placing one of said valves and said auxiliary valve in an open position when fuel in one of the fuel tanks which corresponds to said one of said valves is a type of fuel indicated by said bar code, said control system placing said auxiliary valve in a closed position when a specific gravity of the fuel does not correspond to an acceptable specific gravity for the type of fuel to prevent contaminated fuel from being dispensed into the devise.

2. A system as recited in claim 1, wherein said bar code reader and said auxiliary valve are powered by electric batteries.

3. An apparatus as recited in claim 1, wherein said control system is coupled to said fuel handle and said valves by a radio frequency link.

4. An apparatus as recited in claim 1, wherein said control system is coupled to said fuel handle and said valves by an optical transmitter and receiver device.

5. An apparatus as recited in claim 1, wherein said valves and said auxiliary valve are solenoid valves.

* * * * *